United States Patent [19]

Rodda et al.

[11] Patent Number: 4,487,142

[45] Date of Patent: Dec. 11, 1984

[54] BOBBIN CASE CHAIN STITCH INSERT

[75] Inventors: Donald Rodda, Butler; Charles R. Odermann, Montville, both of N.J.

[73] Assignee: The Singer Company, Stamford, Conn.

[21] Appl. No.: 484,777

[22] Filed: Apr. 14, 1983

[51] Int. Cl.[3] ..... D05B 1/14; D05B 57/04

[52] U.S. Cl. ..... 112/168; 112/202; 112/249

[58] Field of Search ..... 112/165, 168, 184, 201, 112/202, 228, 249

[56] References Cited

U.S. PATENT DOCUMENTS

| | | | |
|---|---|---|---|
| 3,173,390 | 3/1965 | Bartosz | 112/168 |
| 3,173,391 | 3/1965 | Doerner | 112/168 |
| 3,194,197 | 7/1965 | Ketterer et al. | 112/168 |
| 3,253,560 | 5/1966 | Ketterer et al. | 112/168 |
| 3,386,401 | 6/1968 | Johnson | 112/184 |
| 3,720,178 | 3/1973 | Ivanko | 112/168 |
| 4,091,753 | 5/1978 | Johnson et al. | 112/184 |
| 4,278,037 | 7/1981 | Creed et al. | 112/168 |

FOREIGN PATENT DOCUMENTS

| | | | |
|---|---|---|---|
| 1116962 | 11/1961 | Fed. Rep. of Germany | 112/228 |

*Primary Examiner*—Wm. Carter Reynolds
*Attorney, Agent, or Firm*—William V. Ebs; Robert E. Smith; Edward L. Bell

[57] ABSTRACT

A chain stitch insert receivable in the bobbin case of a sewing machine is formed with a topside ledge which captures and consumes thread as a hook point carries a loop of thread around the bobbin case. The ledge enables the formation of chain stitches without the need for a special eyelet on the machine.

2 Claims, 10 Drawing Figures

BOBBIN CASE CHAIN STITCH INSERT

BACKGROUND OF THE INVENTION

1. Field of the Invention

The invention relates to conversion devices for use in enabling chain stitches to be sewn on a lock stitch sewing machine.

2. Description of the Prior Art

Various conversion devices with which a lock stitch sewing machine is enabled to sew chain stitches can be found in the prior art. Such conversion devices commonly include a thread retaining post on which a loop cast off by a looptaker may be retained until the sewing needle has been stepped therethrough, mechanism for stripping the retained loop from the post, and a bobbin case insert for guiding the thread cast off the looptaker onto the post. A lock stitch conversion device as described may be found for example, in U.S. Pat. No. 4,278,037 for "Chain Stitch Conversion for Lock Stitch Sewing Machine" of Gerald J. Creed et al., issued July 14, 1981.

When chain stitches were to be formed on a lock stitch sewing machine fitted with a conversion device, it was necessary to thread the machine differently than for lock stitching. For chain stitching, the thread was passed through a special chain stitch eyelet or guide, effective to limit the quantity of thread supplied to the looptaker by a descending takeup, and so enable the loop-taker to pull loops stripped from the post of the conversion mechanism up to a piece of material being sewn for the setting of chain stitches by the takeup. However, it was easy for an operator to mistakenly thread the machine for lock stitching when it should have been threaded for chain stitching, and when switching from a chain stitching mode to a lock stitching mode to leave the machine threaded for chain stitching. In either event, faulty stitches were produced.

It is a prime object of the present invention to render a lock stitch sewing machine convertible for chain stitch sewing without the need for a special chain stitch guide or eyelet.

It is another object of the invention to provide a bobbin case insert which is effective on a lock stitch sewing machine to consume thread as required for the machine to form chain stitches.

Other objects and advantages of the invention will become apparent during a reading of the specification taken in connection with the accompanying drawings.

SUMMARY OF THE INVENTION

A thread consuming bobbin case insert is provided for use in a lock stitch sewing machine. The insert along with other devices, including a thread retaining post on which a loop cast off a looptaker can be retained until the sewing needle is stepped therethrough, and including mechanism for stripping the retained loop from the post, serves to render the machine capable of sewing chain stitches. The insert includes a ledge which captures the upper limb of a loop of thread while being moved about the bobbin case by the looptaker. Such ledge delays the movement of thread across the top of the bobbin case and so consumes thread enabling the looptaker to pull a loop stripped from the loop retaining post up to a piece of material being sewed for the setting of a chain stitch thereat by the takeup of the machine. The need for a special chain stitch guide or eyelet on the machine is therefor eliminated.

DESCRIPTION OF THE PREFERRED EMBODIMENT

Figures 1, 1A, 2, 3:
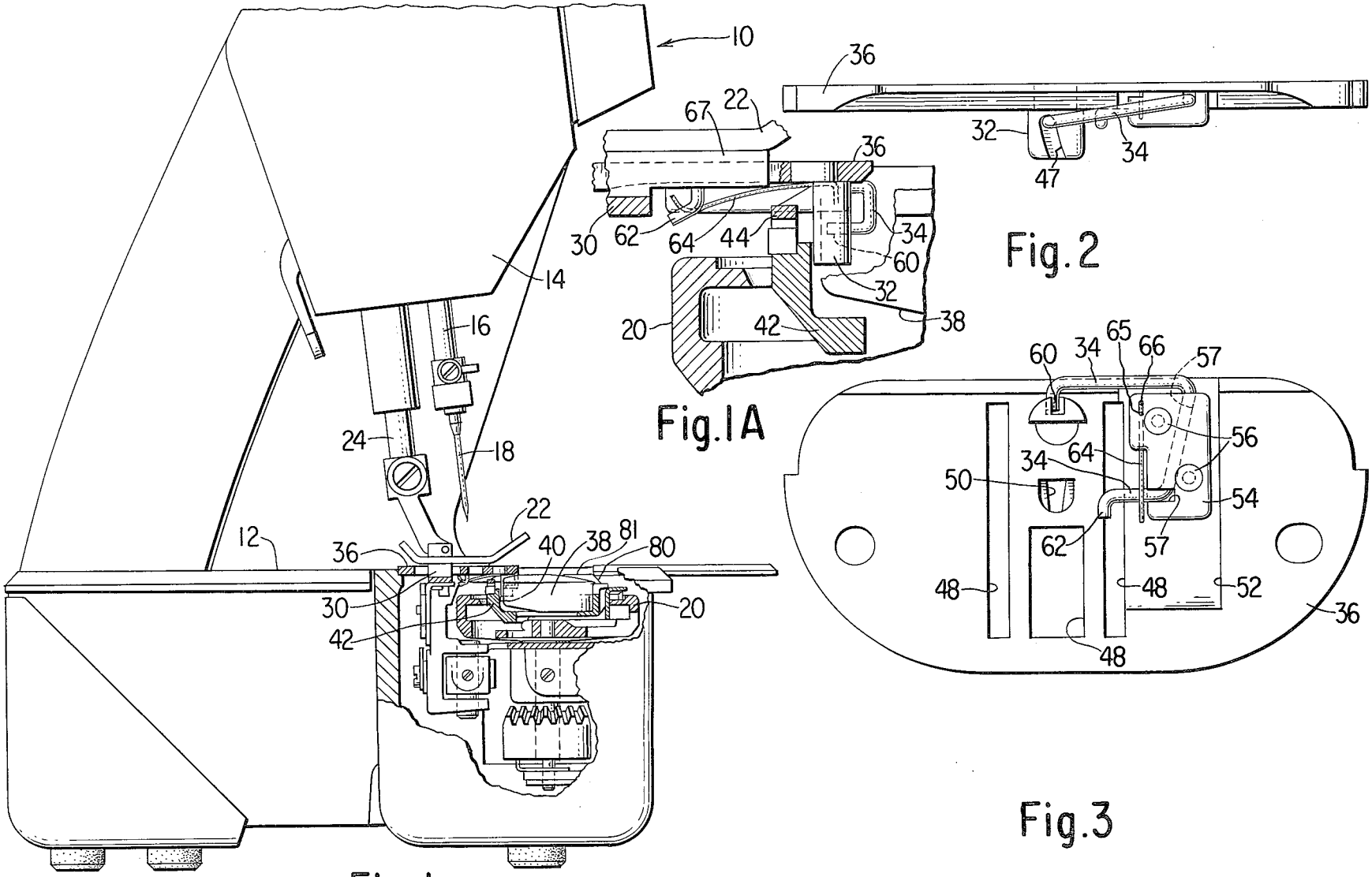
FIG. 1 is a head end elevational view of a lock stitch sewing machine including chain stitch converting mechanism according to the invention, and with the bed partially broken away to expose parts therein.
FIG. 1A is an enlarged fragmentary, vertical, sectional view showing a portion of the mechanism depicted in FIG. 1.
FIG. 2 is a front elevational view of the throat plate illustrated in FIG. 1.
FIG. 3 is a bottom view of the throat plate of FIG. 2.

Referring to the drawings, reference character 10 designates a conventional lock stitch sewing machine, including a work supporting bed 12 and sewing head 14. A needle bar 16 is carried in the sewing head for endwise reciprocation. A sewing needle 18 is affixed in the lower end of the needle bar and cooperates with a rotary looptaker 20 journalled in the bed and driven in timed relationship to the needle bar and takeup of the machine in a manner well understood in the art. A presser foot 22 affixed to a presser bar 24 is utilized to urge fabric 26 and 28 into contact with a feed dog 30 by means of which work is advanced under the needle 18. The feed dog is moved in timed relationship to the needle, looptaker and takeup by conventional work feeding mechanism which may be of the type shown and described, for example, in U.S. Pat. No. 3,527,183 for "Work Feeding Mechanism for Sewing Machines" of The Singer Company, issued Sept. 8, 1972.

Lock stitch machine 10 is rendered capable of sewing chain stitches with conversion mechanism including a loop retaining post 32 and wire loop stripper 34 which depend from the underside of a chain stitch throat plate 36 of the kind shown and described in the aforementioned U.S. Pat. No. 4,278,037. The conversion mechanism also includes a thread controlling insert 38 which is received in the well 40 of a bobbin case 42 that is restrained from rotating in the base 12 of the machine as with a bracket 44.

Depending post 32 serves to temporarily retain successive loops of thread moved about the bobbin case of looptaker 20. Each loop is retained on the post against the action of the takeup 46 of the machine until the sewing needle has passed through the loop, after which the loop is removed from the post with loop stripper 34, and a new loop is formed for subsequent retention. Post 32 is fashioned with an inclined groove 47 to receive one end of the loop stripper 34.

Throat plate 36 is provided with slots 48 to accommodate the feed dog 30, and with an aperture 50 between the feed dog slots to permit the needle 18 to pass through the plate. Adjacent the feed dog slots 48, a trench 52 is cut in the throat plate 36 to accommodate a block 54 which is attached to the throat plate at 56. By reference to FIG. 3, it may be seen that the underside of the block 54 is formed with a groove 57 which extends diagonally from the top of the block to adjacent the bottom edge where the groove turns abruptly and extends out the side of the block. The groove is a guide for loop stripper 34 having one end 60 slidable in the groove 47 on post 32, and having the opposite end 62 extending to lie beneath the adjacent feed dog slot 48. A wire spring 64 having one end 65 located in an aperture 66 in block 54 constantly urges end 62 of loop stripper 34 upwardly towards the throat plate. When the throat plate 36 is installed on the sewing machine, a leg 67 of the feed dog 30 closely adjacent the block 54 extends above end 62 of the wire loop stripper 34 (FIG. 1A), and downward motion of the feed dog during needle penetration causes end 60 of the wire to strip a retained loop from the depending post 32, whereas motion of the feed dog upwardly is followed by end 62 of the wire due to the urgings of the spring 64.

Figure 5:
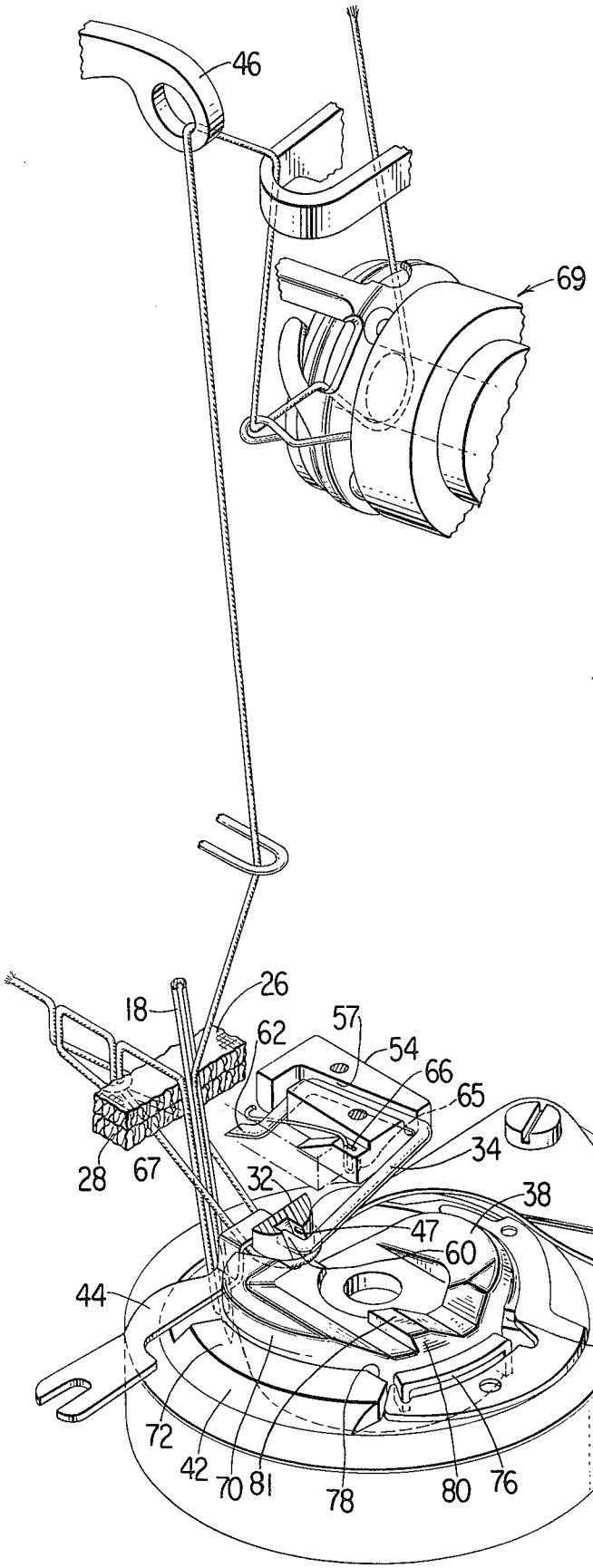
FIG. 5 is a perspective view of portions of the machine of FIG. 1 showing stitch forming instrumentalities, chain stitch conversion mechanism, and thread loops as the sewing needle of the machine penetrates a work piece.
Figure 4:
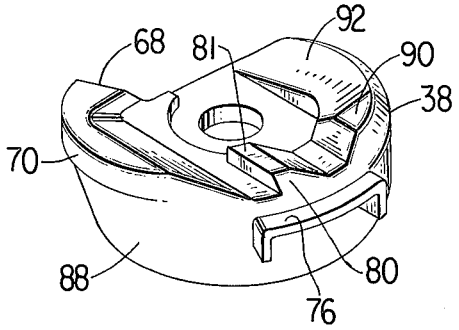
FIG. 4 is a perspective view showing a bobbin case insert according to the invention.

Referring now to FIG. 5, there may be seen fragments of the stitch forming instrumentalities of the sewing machine along with depending post 32 and the block 54. The throat plate 36 to which post 32 and block 54 are attached has not been shown so that the function of these elements may be more readily apparent. Sewing needle 18 with thread extending thereto from a thread tensioning device 69 and over takeup 46 is shown extending through fabric 26 and 28, and through a loop retained on depending post 32, the depending post being of sufficient width to insure that the sewing needle 18 steps through retained loops without fraying or piercing the thread thereof. End 60 of the wire loop stripper 34 extends into the groove 47 of the depending post 32 above the loop retained thereon. End 62 of the wire stripper 34 extending beneath one leg of feed dog 30 has been moved an insufficient distance by the feed dog to cause the end 60 of the wire to strip the loop from the depending post 32. The loop taker 20 carries therein the bobbin case 42, and set within the bobbin case is the insert 38.

Insert 38 takes the place of the bobbin normally present in the bobbin case 42 during lock stitch sewing, and provides a relief 68 into which the depending post 32 attached to the throat plate 36 may extend. The insert 38 directs the loop shed by the loop taker 20 to the depending post 32, and eliminates the possibility of skipped stitches due to the shed loop avoiding the post.

The looptaker 20, post 32, loop stripper 34, and insert 38 cooperate to provide for the formation of chain stitches in machine 10 in much the same way as described in the aforementioned U.S. Pat. No. 4,278,037, which is incorporated herein by reference. It is therefor unnecessary to describe the operation of the converting mechanism in detail herein, except, however, for insert 38 which is specially formed according to the invention to perform an additional function to that described in the patent. Successive loops of thread presented for pick-up to the hook 71 of the looptaker by the needle 18 are moved about the bobbin case by the looptaker during the rotation thereof. Each loop after being cast off the looptaker is retained on depending post 32 until the needle 18 steps through the retained loop after which the retained loop is stripped from the post by wire stripper 34, and a succeeding loop is moved about the bobbin case, all as described in the said patent.

As stated, insert 38 is specially formed according to the invention. The insert is formed with a ledge 70 to rise above and overlap the top surface 72 of the bobbin case 42. Ledge 70 is located on one side of the insert between recess 68 and a key 76 which is received in a cut-out 78 in the bobbin case. The insert also includes a ramp 80 extending to an elevated surface 81. Insert 38 is preferably a one-piece molded plastic piece.

Figure 6:
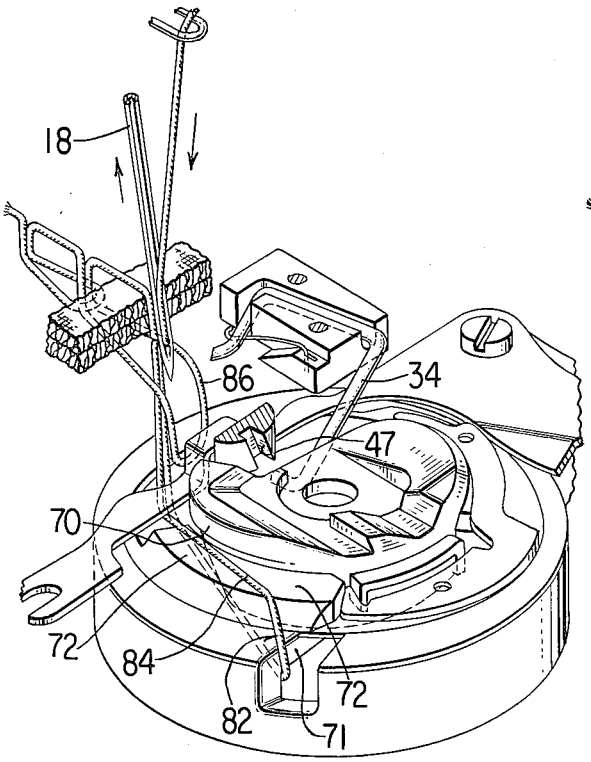
FIGS. 6, 7, 8 and 9 are perspective views showing the stitch forming instrumentalities, chain stitch conversion mechanism, and thread loops in different positions of the sewing needle.
Figure 8:
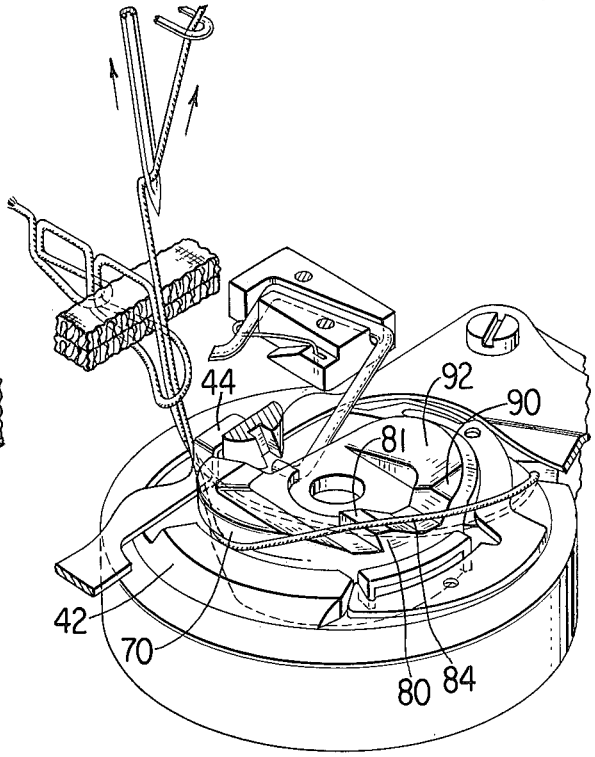
Figure 7:
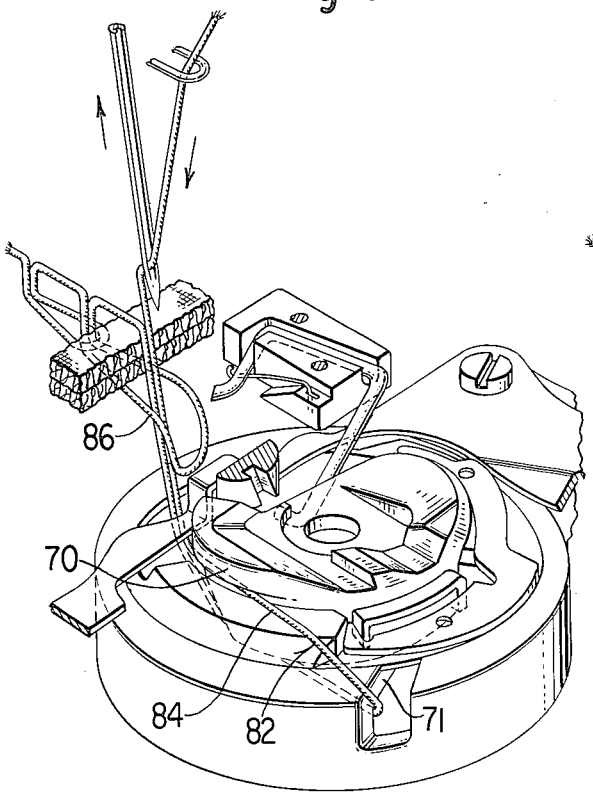
Figure 9:
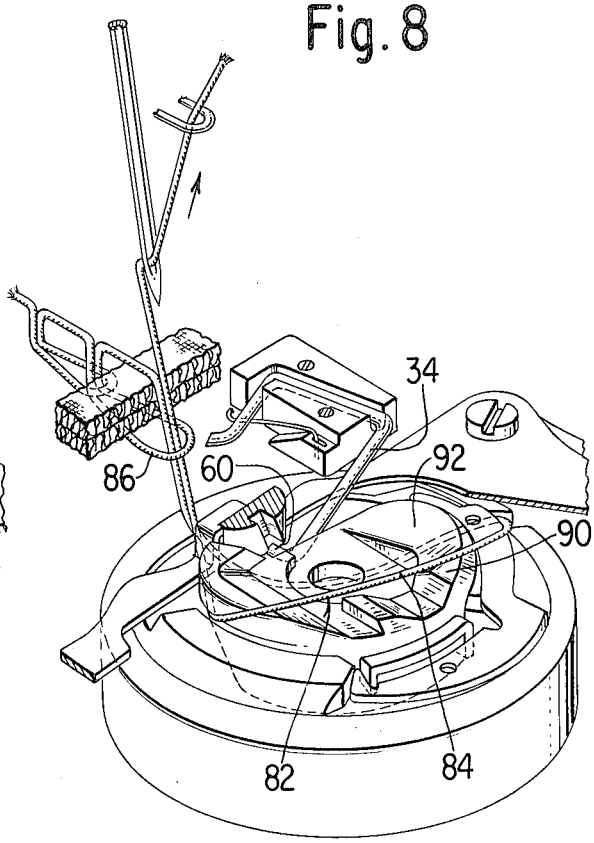

Insert 38 controls the movement of a loop 82 of thread about the bobbin case 42 in a manner made apparent in FIGS. 6, 7, 8 and 9. During the initial portion of the movement of loop 82 about the bobbin case, upper limb 84 of the loop moves across the top surface 72 of bobbin case 42 approaching insert 38 (FIG. 6). Needle 18 is then moving upwardly out of the work 26 and 28, the takeup 46 is moving downwardly, and a previous loop 86 has been stripped from post 32 by wire stripper 34. As loop 82 is moved further about the bobbin case to the position shown in FIG. 7 by hook 71, limb 84 is caused to move under ledge 70, and is captured thereby against depending flange 88 on the insert. At the same time, needle 18 continues to move upwardly and the takeup downwardly. While limb 84 is captured under ledge 70, loop 82 is prevented from moving across the insert. Thread is therefor consumed by rotation of the looptaker and prior loop 86, which has been removed from post 32, is drawn upwardly toward the work. Continued rotation of the looptaker causes limb 84 to ride up ramp 80 onto elevated surface 81 and the thread is thereby caused to gradually move out from under, over and about ledge 70 (FIG. 8). In the FIG. 8 position of the looptaker, the needle has moved to the elevated position indicated and the takeup has moved upwardly. As the looptaker continues to rotate, limb 84 is caused to ride up ramp 90 onto an elevated surface 92 on the insert (FIG. 9) and while thereon is cast off hook 71. As the looptaker rotates further, the feed dog 30 moves upwardly and is followed by end 62 of loop stripper 34, due to the upward bias of spring 64 thereon. The loop stripper pivots in groove 57 causing end 60 to move upwardly in groove 47, and the takeup 46 with continued upward movement pulls loop 82 under loop stripper 34 onto post 32 and sets a chain stitch in the work with loop 86.

Although the invention has been described with a certain degree of particularity, it is to be understood that the present disclosure of the preferred form has been by way of example and that numerous changes in the details of construction, and the combination and arrangement of parts may be resorted to without departing from the spirit and scope of the invention.

We claim:

1. In a lock stitch sewing machine, a sewing needle, a stationary bobbin case, a looptaker to pick up a loop of thread presented thereto by the needle and carry the loop about the bobbin case, a post to hold the loop after cast off from the looptaker and so permit the needle to penetrate the held loop while presenting a new loop to the looptaker for movement thereby around the bobbin case, means for stripping the held loop from the post after penetration by the needle, and a stationary insert within the bobbin case, said insert including a ledge which overlaps a top surface of the bobbin case and including a depending flange under the ledge, the ledge being disposed to capture thread thereunder from an upper limb of the new loop being moved about the bobbin case whereby movement of the new loop across the bobbin case is delayed and the looptaker is enabled to pull a loop stripped from the retaining post up to material being sewn for the setting of a chain stitch therein, the insert including means for elevating said upper limb of thread and thereby causing the thread to be moved out from under and over said ledge.

2. The combination of claim 1 wherein the elevating means for causing thread to be moved out from under and over the ledge includes spaced apart ramps which sucessively engage and raise the upper limb of the thread to elevated surfaces on the insert.

* * * * *